US008096027B2

(12) United States Patent
Jung et al.

(10) Patent No.: US 8,096,027 B2
(45) Date of Patent: Jan. 17, 2012

(54) TWIN BUCKLE ASSEMBLY WITH DUAL RELEASE POSITIONS

(75) Inventors: Marc Jung, Largo, FL (US); Jason Chin, Parrish, FL (US)

(73) Assignee: Conax Florida Corporation, St. Petersburg, FL (US)

( * ) Notice: Subject to any disclaimer, the term of this patent is extended or adjusted under 35 U.S.C. 154(b) by 114 days.

(21) Appl. No.: 12/546,914

(22) Filed: Aug. 25, 2009

(65) Prior Publication Data

US 2010/0186204 A1 Jul. 29, 2010

Related U.S. Application Data

(60) Provisional application No. 61/091,876, filed on Aug. 26, 2008.

(51) Int. Cl.
*A44B 11/25* (2006.01)

(52) U.S. Cl. ..... 24/637; 24/638; 24/631

(58) Field of Classification Search ..... 24/638, 24/630, 631, 632, 636, 637, 643, 646, 191, 24/648

See application file for complete search history.

(56) References Cited

U.S. PATENT DOCUMENTS

| | | | | |
|---|---|---|---|---|
| 3,576,056 | A | 4/1971 | Barcus | |
| 4,644,618 | A * | 2/1987 | Holmberg et al. | 24/630 |
| 5,813,097 | A | 9/1998 | Woellert et al. | |
| 5,996,192 | A | 12/1999 | Haines et al. | |
| 7,263,750 | B2 * | 9/2007 | Keene et al. | 24/638 |

* cited by examiner

*Primary Examiner* — Robert Sandy
*Assistant Examiner* — Louis Mercado

(57) ABSTRACT

A twin buckle assembly is provided with dual release positions. The buckle assembly can lockingly secure two buckle tongues. The buckle assembly includes a single, pivotal latch mechanism that can separately secure one or both of the buckle tongues. Pivotal movement of the latch occurs upon rotation of the buckle cover. Thus, one tongue is released at a first rotational position of the cover and both tongues are released at a second rotational position of the cover. The buckle assembly, thereby, allows the independent removal of lap and shoulder belts.

8 Claims, 4 Drawing Sheets

TWIN BUCKLE ASSEMBLY WITH DUAL RELEASE POSITIONS

CROSS REFERENCE TO RELATED APPLICATIONS

This application claims priority to provisional application Ser. No. 61/091,876 filed on Aug. 26, 2008 and entitled "Twin Buckle Assembly with Dual Release Positions." The contents of this co-pending application are fully incorporated by referenced herein.

FIELD OF THE INVENTION

This invention relates to a buckle assembly that accepts tongue plates from separate restraint belts. The invention also relates to a buckle assembly with dual release positions.

DESCRIPTION OF THE BACKGROUND ART

The use of restraint systems is now common place, and even mandatory, in a wide variety of vehicles. Aircraft, both fixed wing and rotary, and most types of land vehicles now all use restraints to prevent injury to vehicle occupants. Restraint systems are likewise used in watercraft. These restraint systems typically include lap and shoulder belts that secured to a single tongue plate. The tongue plate, in turn, is releasably secured within a female receptacle of the buckle assembly.

This conventional design, however, is not acceptable in all situations. For instance, sometimes vehicle occupants are wearing heavy or bulky clothing. This situation may occur, for instance, when the occupants are firemen wearing fire retardant clothing, or soldiers wearing body armor. Other situations arise where the occupant may need to release the shoulder belt without also releasing the lap belt. In such cases, the use of conventional restraint systems is simply not possible. Namely, these situations require lap and shoulder belts that can be independently removed and/or adjusted.

An example of a buckle assembly with multiple belt connectors is disclosed in U.S. Pat. No. 7,263,750 to Keene. Keene discloses a buckle assembly for a vehicle restraint system where the buckle assembly is adapted to receive a plurality of belt connectors. The belt connectors are simultaneously released upon moving at least one handle to a release position.

Although the inventions of the prior art achieve particular objectives, these inventions also suffer from common drawbacks. These inventions, for instance, do not permit tongue plates to be separately removed so as to permit the independent removal and/or adjustment of lap and shoulder belts. These inventions, likewise, do not provide a buckle wherein a single latching mechanism is used to secure both tongue plates.

SUMMARY OF THE INVENTION

It is therefore one of the objectives of the present invention to provide a buckle mechanism that accepts two or more tongues plates and wherein the buckle mechanism allows the plates to be separately removed.

It is another objective of this invention to provide a buckle with a single latch mechanism that can selectively secure one or both of the tongue plates.

It is still yet another objective of this invention to provide a buckle mechanism with a cover plate, wherein the tongue plates are removable at distinct angular positions of the cover plate.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a twin buckle assembly with dual release positions. More particularly, the invention relates to a buckle assembly that can lockingly secure two buckle tongues. The buckle assembly includes a single, pivotal latch mechanism that can separately secure one or both of the buckle tongues. Pivotal movement of the latch occurs upon rotation of the buckle cover. Thus, one tongue is released at a first rotational position of the cover and both tongues are released at a second rotational position of the cover. The buckle assembly, thereby, allows the independent removal of lap and shoulder belts.

Figure 1:
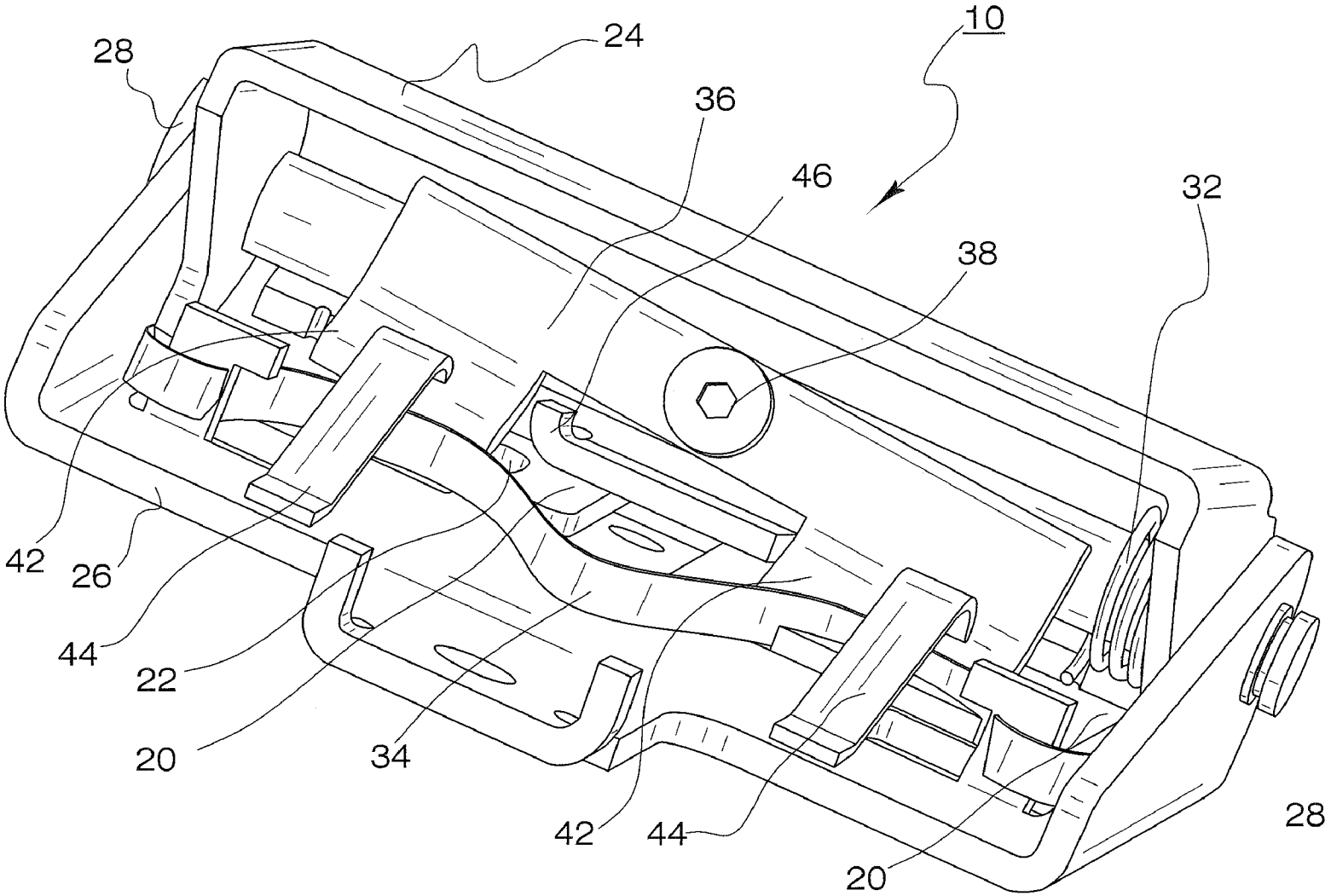
FIG. 1 is a perspective cut away view of the buckle assembly of the present invention.
Figure 2:
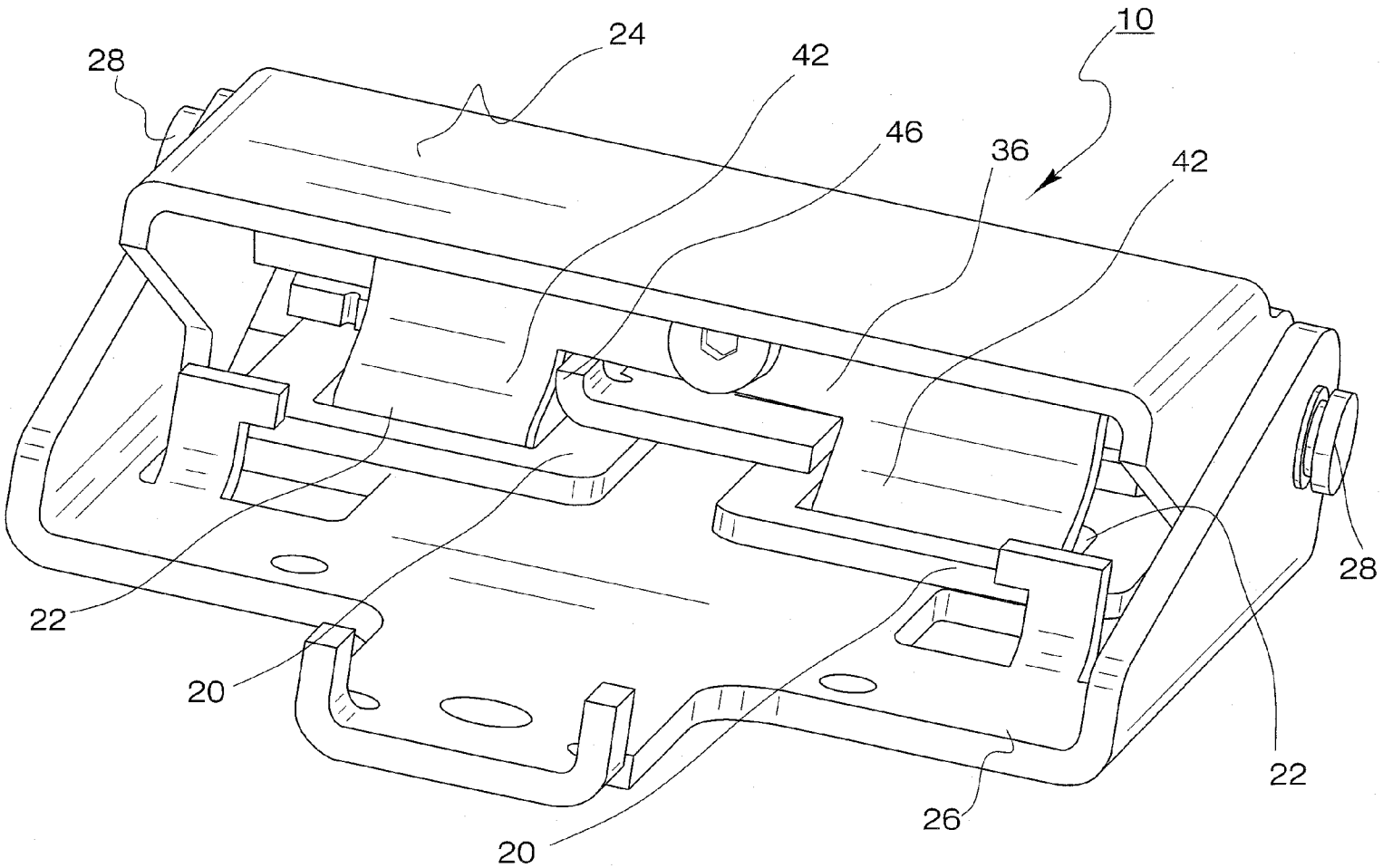
FIG. 2 is a perspective cut away view of the buckle assembly in the closed, locked position, wherein both tongues are secured.

FIG. 1 is a perspective view of the buckle assembly 10 with the two releasably connected tongue plates 20. Each tongue plate 20 is secured to either a lap or a should belt. Each tongue plate 20 further includes a female aperture 22 that allows the plate to be lockingly secured to buckle assembly 10, as more fully described herein. Buckle assembly 10 includes an upper cover 24 and a lower base 26. Lower base 26 is adapted to be mounted within the vehicle. Cover 24 and base 26 are formed from inter-fitting u-shaped members that are pivotally interconnected along a pivot pin 28. A cover spring 32 is positioned about the pivot pin 28 and serves to bias cover 24 into the closed orientation depicted in FIG. 2.

With continuing reference to FIG. 1, an ejector spring 34 is secured within the interior of buckle assembly 10. Ejector spring 34 includes opposing ends that are secured to upstanding flanges of base 26. Opposing extents of ejector spring 34 are curved forwardly to contact the tongue plates 20 as they are inserted within buckle assembly 10. When either tongue plate 20 is released, the adjacent extent of the ejector spring 34 serves to urge the tongue plate out of the assembly 10. Conversely, when an occupant is inserting a tongue plate 20, a sufficient amount of force must be applied in order to overcome the bias of spring 34.

Tongue plates 20 are lockingly secured within buckle assembly 10 by way of a pivotal latch 36. Pivotal latch 36 is rotatably secured to the intermediate extent pivot pin 28 by way of a latch pin 38. Latch pin 38 secures latch 36 while at the same time permitting it to freely rock back and forth about an axis that is perpendicular to the axis of pin 28. Latch 36 further includes opposing male portions 42 that are dimensioned to fit into the female openings 22 within tongue plates 20. Each male portion 42 has a slight upward curve, the function of which is described hereinafter.

Buckle assembly 10 further includes two latch springs 44. Each latch spring 44 has a proximal end that is affixed to base 26 and a distal end that rides within the curved extent of a corresponding male portion 42. This upward curvature ensures that positive contact is maintained between the male portion 42 and the distal end of the corresponding latch spring 44. Latch springs 44 serve to urge male portions 42 into the female openings 22 of buckle plates 20. Namely, latch springs 44 apply a downward force upon male portions 42, so as to bring male portions 42 into locking engagement with tongue plates 20.

Figure 3:
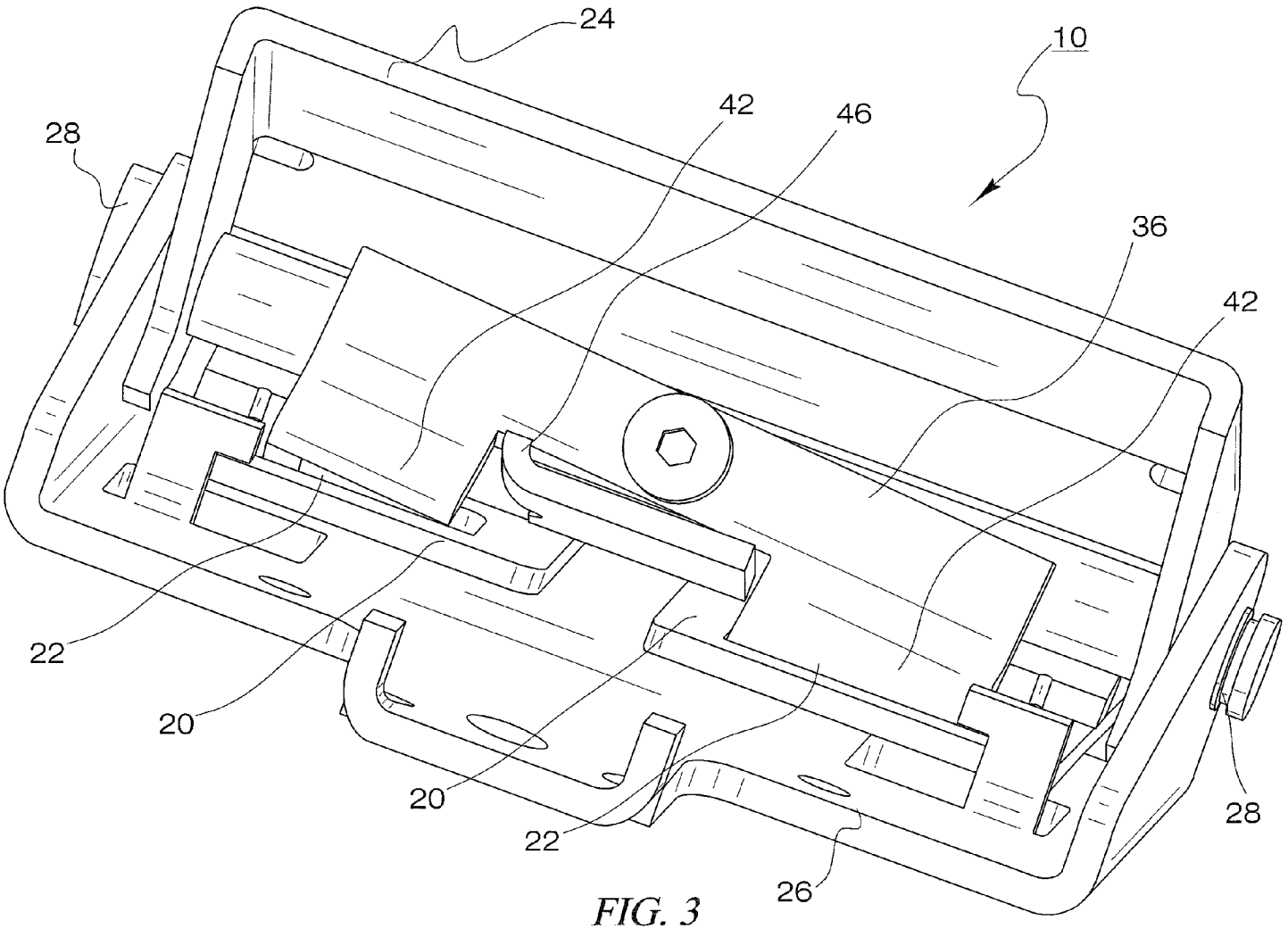
FIG. 3 is a perspective cut away view of the buckle assembly in the partially opened position, wherein one tongue is released.

Male portions 42 can thereafter be unlocked from tongue plate 20 via the rotation of cover 24. Namely, cover 24 includes an extension that extends underneath pivot pin 28. The extension includes a finger-like projection 46 that functions in contacting latch 36. As noted by FIG. 3, rotating cover 24 approximately 45 degrees serves to bring projection 46 into contact with latch 36. Upon the continued rotation of cover 24, projection 46 rotates latch 36 in the clockwise direction (as viewed in FIG. 1). This clockwise rotation of latch 36 is sufficient to overcome the force of latch spring 44 and remove male portion 42 from its locked position within aperture 22. In this manner, rotation of cover 42 releases one tongue plate 20 from the buckle assembly 10.

Figure 4:
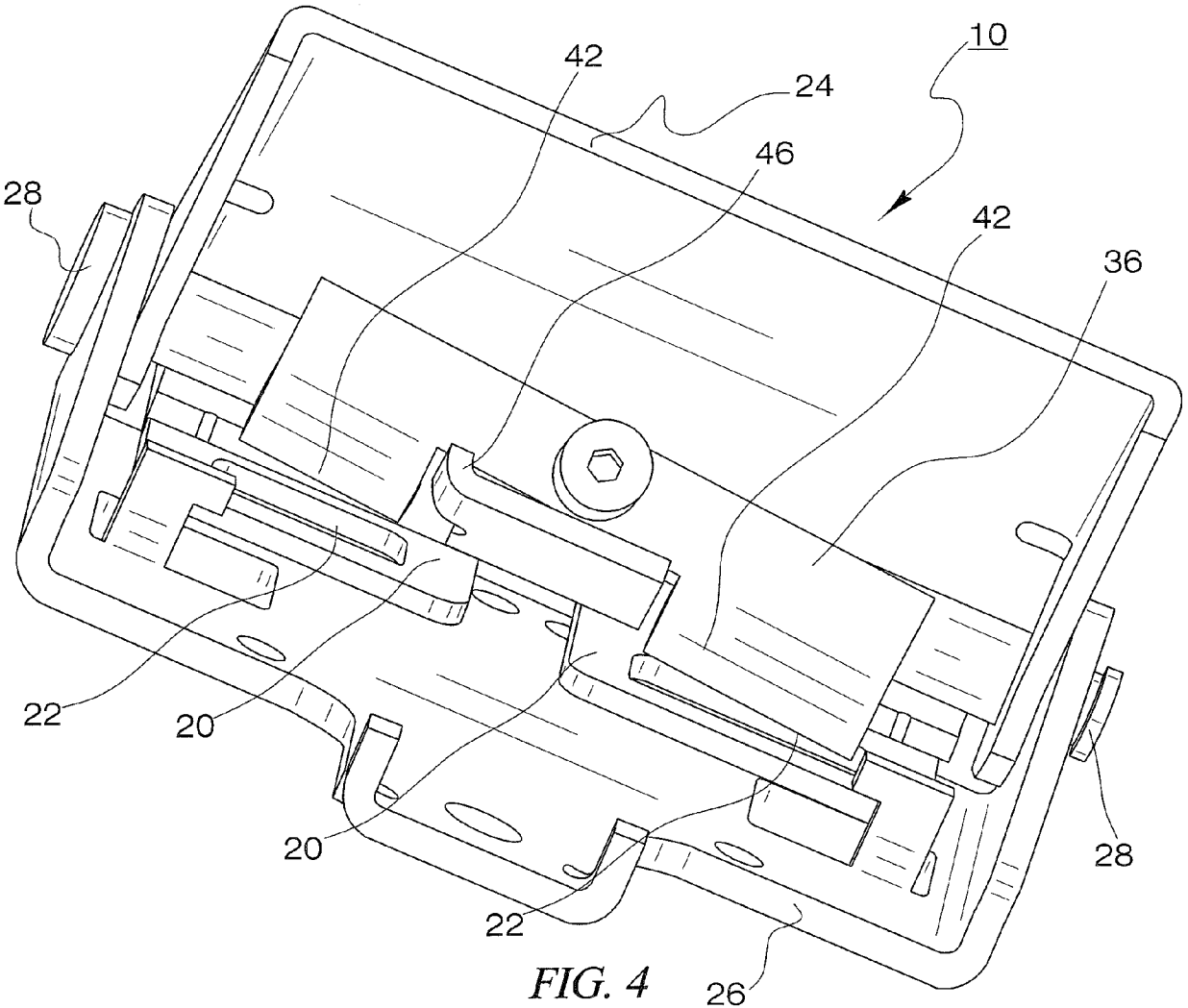
FIG. 4 is a perspective cut away view of the buckle assembly in the fully opened position, wherein both tongues are released.

The remaining male portion 42 is removed from its female aperture 22 via the continued rotation of cover 24. Namely, as noted in FIG. 4, by rotating cover 24 into the 90 degree position, latch 36 is lifted upwardly enough so that both male portions 42 are lifted out of female apertures 22. In this orientation, both tongue plates 20 are ejected from buckle assembly 10.

In use, with cover 24 in the closed orientation as depicted in FIG. 1, an occupant can selectively insert one or both tongue plates 20 into buckle assembly 10. This is accomplished by inserting the tongue plate 20 with a sufficient degree of force to overcome the bias of ejection spring 34. During insertion, the downward bias of latch spring 44 is also overcome, so as to permit latch 36 to pivot and provide the necessary clearance for tongue plate 20. Latch 36 pivots back to a neutral position once male portion 42 is properly positioned within female extent 22. With male portion 42 within female extent 22, the tongue plate 20 is locked within buckle assembly 10. The opposing tongue plate 20 can be similarly inserted into the opposite side of buckle assembly 10.

In order to remove either tongue plate 20, cover 24 must be rotated upwardly with sufficient force to overcome the bias of cover spring 32. Assembly 10 releases one of the tongue plates 20 when cover 24 is pivoted beyond a 45 degree angle. The remaining tongue plate 20 is released when cover 24 is pivoted at a 90 degree angle. This gives the occupant the option of removing a shoulder belt prior to removing the lap belt. Alternatively, the occupant could opt to simultaneously release both belts by simply rotating cover 24 to the 90 degree position.

The first tongue plate 20 is ejected by way of protrusion 46. Namely, when cover 24 is rotated beyond the 45 degree position, protrusion 46 engages an intermediate extent of latch 36. Continued rotation of cover 24 results in protrusion 46 pivoting latch 36 about latch pin 38. This causes the corresponding male portion 42 of latch 36 to be lifted out of the female portion 22 of tongue plate 20. In this regard, the force applied by projection 46 is sufficient to overcome the downward bias applied by latch spring 44. Continued rotation of cover plate 24 results in both male portions 42 being lifted out of the female openings 22 in plates 20. Both tongue plates 20 are thereafter ejected from buckle assembly 10.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A buckle assembly for accepting and ejecting dual tongue plates, each of the tongue plates including an aperture, the buckle assembly comprising:

a base having a lower surface and upstanding side edges, an ejection spring positioned within the base;

a cover pivotally connected to the base by way of a pivot pin and cover spring, the pivot pin having an axis, the cover spring functioning to bias the cover to a closed orientation;

a pivotal latch including opposing first and second male portions, the latch being pivotally connected to the pivot pin by way of a latch pin, the latch pin having an axis that is perpendicular to the axis of the pivot pin, a pair of springs secured to the base and urging the first and second male portions of the latch into the apertures of the tongue plates;

a finger projection secured to the cover, the finger projection contacting and rotating the pivotal latch when the cover is rotated by 45 degrees or more, whereby rotation of the pivotal latch overcomes the bias of the associated spring such that the first male portion is removed from the aperture of the tongue plate, and whereby both the first and second male portions are removed from the apertures of the tongue plates when the cover is rotated by 90 degrees or more.

2. A buckle assembly for accepting and ejecting dual tongue plates, each of the tongue plates including an aperture, the buckle assembly comprising:

a base having a lower surface and upstanding side edges;

a cover pivotally connected to the base by way of a pivot pin, the pivot pin having an axis;

a pivotal latch pivoting about an axis that is perpendicular to the axis of the pivot pin, the pivotal latch including opposing first and second male elements, the latch being pivotally connected to the pivot pin;

a projection secured to the cover, the projection contacting and rotating the pivotal latch when the cover is rotated, whereby clockwise rotation of the pivotal latch removes the first male element from the aperture of a tongue plate, and whereby the continued rotation of the cover removes both the first and second male elements from the apertures of the tongue plates.

3. The buckle assembly as described in claim 2 further comprising a cover spring that urges the cover to a closed orientation over the base.

4. The buckle assembly as described in claim 2 further comprising a pair of latch springs that are secured to the base and which urge the male elements into the apertures of the tongue plates.

5. The buckle assembly as described in claim 2 wherein the first male element is removed from the aperture of a corresponding tongue plate only after the cover has been rotated by at least 45 degrees.

6. The buckle assembly as described in claim 2 wherein both male elements are removed after the cover has been rotated by 90 degrees.

7. The buckle assembly as described in claim 2 further comprising an ejector spring that forcibly ejects the tongue plates after the male elements have been released.

8. A buckle assembly for accepting and ejecting dual tongue plates, each of the tongue plates including an aperture, the buckle assembly comprising:

a housing including a pivotal cover;

a pivotal latch including opposing first and, second male elements, the latch being pivotally interconnected to the cover, the cover and the latch pivoting about respective axes that are perpendicular to each other;

a projection secured to the cover, the projection contacting and rotating the pivotal latch when the cover is rotated, whereby clockwise rotation of the pivotal latch removes the first male element from the aperture of a tongue plate, and whereby the continued rotation of the cover removes both the first and second male elements from the apertures of the tongue plates.

* * * * *